United States Patent [19]

Gardner

[11] 4,141,421

[45] Feb. 27, 1979

[54] UNDER REAMER

[76] Inventor: Benjamin R. Gardner, 4642 Idlewild Rd., Salt Lake City, Utah 84117

[21] Appl. No.: 825,290

[22] Filed: Aug. 17, 1977

[51] Int. Cl.[2] ..... E21B 9/28; E21B 9/32

[52] U.S. Cl. ..... 175/263; 175/265; 175/334; 175/344; 175/347; 175/374; 15/104.13

[58] Field of Search ..... 175/232, 263, 265, 266, 175/290, 291, 342, 344, 345, 292, 371; 299/80; 82/1.2; 408/146, 147; 15/104.13, 104.14

[56] References Cited

U.S. PATENT DOCUMENTS

| | | | |
|---|---|---|---|
| 1,611,071 | 12/1926 | Reed | 175/263 X |
| 1,801,265 | 4/1931 | Copelin | 175/292 X |
| 1,837,423 | 12/1931 | Foster | 175/343 X |
| 1,899,727 | 2/1933 | Sandstone | 175/263 |
| 2,085,336 | 6/1937 | Sandstone | 175/263 X |
| 3,977,481 | 8/1976 | Fisk et al. | 175/345 X |
| 3,990,525 | 11/1976 | Penny | 175/371 X |

*Primary Examiner*—Ernest R. Purser
*Assistant Examiner*—Nick A. Nichols, Jr.
*Attorney, Agent, or Firm*—M. Reid Russell

[57] ABSTRACT

The present invention consists of an under reamer tool for enlarging, scraping or smoothing a well bore. The tool is attached to a conventional drill string above a conventional bit and involves cutting elements that have retractable cutters arranged for extension from the tool to engage the well bore wall, each cutter, when the drill string is turned, being urged outwardly by centrifugal force until it engages the well bore wall, continued turning thereafter, pulling that cutter into its extended cutting attitude, reaming the wall to the desired diameter, cutter retraction involving ceasing turning the drill string and the pulling of the drill string and connected tool from the well bore. During that pulling should the cutter contact a shoe or first reduction of the well bore casing or the wall thereof, it will be urged into a stowed attitude recessed within the tool body, the under reamer tool of the present invention also incorporating scouring openings provided in the tool body opposite to the cutter storage areas to pass liquid or air therethrough from the drill string to purge and clean that area within the tool body, allowing the cutter to travel freely therein.

8 Claims, 5 Drawing Figures

UNDER REAMER

BRIEF DESCRIPTION OF THE INVENTION

1. Field of the Invention

This invention relates to tools arranged with a conventional drill string for reaming well bores to a desired diameter during or after drilling of that well bore.

2. Prior Art

Under reamers useful for expanding well bores have long been in common use and it has been common to provide such tools with cutting members that are designed to be moved or extended against a well bore wall after the tool is positioned within the well bore, for turning through a conventional drill string to effect a desired widening of all or sections of the well bore. An example of one such under reaming tool is shown in a U.S. Pat. No. 1,739,823. The device of this patent involves mechanically controlled cutting elements that are operated through a drill string, and are capable of being extended and retracted by an operator on the surface.

Another example of an under reamer tool for arrangement within a conventional drill string is shown in a U.S. Pat. No. 2,809,015. The tool of this patent also involves mechanically moved and controlled cutting elements for movement into engagement with a well bore wall, which movement is effected by a compression of the tool as by appropriate unlocking thereof and forcing the drill string downward to extend outwardly the cutting elements thereof.

Unlike the above-cited mechanically operated reaming tools, the present invention does not involve any direct linkage, either mechanical or electrical, through the drill string to the surface to command or effect the extension or retraction of cutter portions of cutting elements thereof. The cutters of the present invention are moved outwardly by centrifugal force as when the drill string and present invention are turned, until a cutting edge of each cutter portion contacts and is thereafter drawn into the wall of the well bore with retracting of the individual cutters being effected with the drill string stationary and whereafter it and the tool are lifted from the well bore. The edge of each cutter, should it contact the well bore wall, or a shoe, or a first diameter reduction of casing therein, or the like, being urged into a retracted attitude or position within the tool body; the under reamer tool of the present invention, therefore, being different in both construction and operation from the above-cited prior art devices.

An additional example of an under reamer tool for use in a drill string that is operated by fluid pressure is shown in U.S. Pat. No. 3,556,233, which patent, as per the above discussion, is also unlike the under reamer tool of the present invention.

Within the knowledge of the inventor, the under reamer of the present invention is unlike in its construction or use any machine or device known for enlarging a well bore.

SUMMARY OF THE INVENTION

It is a principal object of the present invention to provide an under reamer tool for arrangement in a conventional drill string, the tool involving movable cutting elements that are capable of extension from and retraction to within the tool body for enlarging a well bore with extension and retraction thereof being controlled only by turning the drill string and pulling that drill string from the well bore.

Another object of the present invention is to provide an under reamer tool capable of being inserted through a pipe or liner arranged within a well bore, which tool will, under the impetus of centrifugal force when the drill string connected thereto is turned, extend cutters thereof into engagement with the well bore wall immediately below that pipe to ream away materials therebelow so that the pipe can be further inserted into that well bore, but will retract into the tool body, allowing the tool to be withdrawn through that pipe when the drill string is lifted from the well bore.

Another object of the present invention is to provide an under reamer tool for installation in a conventional drill string immediately above a conventional bit arrangement whereby the turning of the drill string turns also the under reamer tool to widen out the well bore as that well is being drilled.

Still another object of the present invention is to provide an under reamer tool having cutters thereof that are journaled or arranged on appropriate journaled units to travel within the tool body under the impetus of centrifugal force to extend therefrom to engage the wall of a well bore wherein the tool is turned, which cutters will retract back into the tool body when the tool is not turned and should the top of a cutter contact an object such as the well bore wall, or a shoe, first diameter reduction, or the like, of a pipe or liner therein when said tool and connected drill string are withdrawn from the well bore.

Still another object of the present invention is to provide an under reamer tool that is simple to construct with all movable elements thereof being arranged so as to be independent from direct control or linked to the well bore surface other than through the drill string connection to the tool, cutters of the tool being extended under the impetus of centrifugal force when the tool and drill string are turned, the cutters being drawn into the wall of a well bore to uniformly enlarge that well bore when they are moved outwardly to contact therewith, which cutters will retract automatically as the drill string is lifted from the well bore, and when the top edge of each cutter contacts the wall of a well bore, a shoe, first diameter reduction, or the like, or a pipe therein, the cutter will be urged to a retracted attitude within the tool body, the area within the tool body within which the cutter is retracted being arranged to receive a continuous fluid purge during turning of the drill string.

Briefly stated, the present invention comprises an under reamer tool for appropriate connection in a conventional drill string above a bit, the tool of the present invention being turned by that drill string, as is the bit, to enlarge all or part of a well bore to a desired diameter. The tool of the present invention includes a cylindrical body formed from steel or the like, that has a plurality of elongated transverse openings formed therein that contain aslant shafts or crosshead guides on which shafts or guides are journaled cutters or crossheads mounting cutters. The aslant attitude of the individual shaft or crosshead guide is such that it forms an angle outwardly from the body longitudinal center to the well bore wall such that the individual cutter will make an optimum cutting angle for intrusion into the well bore wall and will be drawn into the wall when an edge thereof first contacts that wall, with retraction of the individual cutter or crosshead and mounted cutter occurring when the drill string is pulled from the well bore and a top edge of each such cutter contacts the well bore wall, a shoe, or end of a well bore liner, or the like, with the cutter thereby being urged back along the shaft or crosshead track into a recessed attitude within the tool body.

The preferred cutter has arranged, as the cutting and well bore wall engaging surface, a flat or somewhat rounded cutting surface that is capable of reaming away to a flat surface, the well bore wall. Such cutter preferably has a cone shape and incorporates appropriate roller bearings that are arranged in a center longitudinal hole therethrough, journaling the individual cutter onto the shaft or onto a post of the crosshead. The individual cutter also incorporating at least one thrust bearing therewith to absorb forces generated when the cutter cuts into the well bore wall.

The under reamer tool of the present invention also incorporates an appropriate threaded shaft or stem on one end thereof for attaching it to a drill string and an appropriate threaded collar or recess therein for coupling a conventional bit thereto. Further, within the tool body are arranged purge ports that intersect a longitudinal fluid flow passage that passes through the tool body and into the bit therebelow, which purge ports will pass liquid therethrough to continuously scour out materials from the within area of the tool body that houses the cutters or crossheads therein when said cutters or crossheads are moved into a stowed attitude.

Further objects and features of the present invention will become apparent from the following detailed description, taken together with the accompanying drawings.

THE DRAWINGS

FIG. 1 is a side elevation view of an under reamer tool of the present invention shown arranged within a well bore attached to a drill string, the tool having a conventional drill bit attached to its lower end, showing also portions thereof broken away to expose portions of the tool interior;

FIG. 2, a top plan sectional view taken along a line 2—2 of FIG. 1, showing a first preferred embodiment of the tool's arrangement of cutting elements, each having cutters thereof extended into the wall of the well bore as when the tool is operated to enlarge a well bore;

FIG. 3, an exploded sectional view taken within the line 3—3 of FIG. 1, showing a cutting element as consisting of a cutter that is journaled onto a shaft to slide up and down thereon, that cutter as shown in broken lines, is being moved to a stowed attitude within the tool body;

FIG. 4, a sectional view of a second embodiment of a cutting element that should be taken as preferably being incorporated with the tool of FIG. 1, and involves a cutter that is journaled to a crosshead that is arranged to travel on a crosshead guide, the crosshead in broken lines, shown as having been moved to a recessed attitutde within the tool body; and FIG. 5, a top plan sectional view taken along the line 5—5 of FIG. 4, showing a post portion of the crosshead whereon the cutter is journaled, the crosshead shown arranged on the crosshead guide that is secured to the tool body.

DETAILED DESCRIPTION

Figure 1:
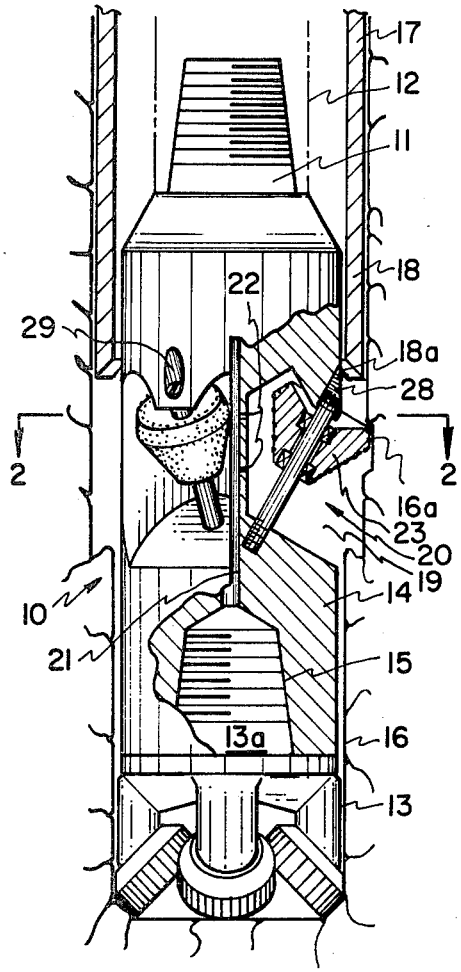

Referring now to the drawings:

In FIG. 1 is shown a preferred embodiment of an under reamer tool 10 of the present invention, hereinafter referred to as a tool, that is shown connected at a threaded neck portion 11 thereof, to the end of a conventional drill string 12 that is shown in broken lines. Attached at a threaded collar or recess 15 within tool 10 opposite to neck 11 is shown a conventional drill bit 13 having a threaded shank portion **13*a* that is turned appropriately into the threaded collar or recess 15 formed within a cylindrical body 14 of tool 10. The tool 10 and a portion of drill bit 13 are shown in FIG. 1 in cross section as being arranged within a conventional well bore 16, the drill bit turned therein to form a bore whose diameter is reflective of its cross section configuration, the following tool 10 enlarging that bore to the desired diameter so that a pipe or liner 17 can be installed therein. Shown in FIG. 1, the liner 17 has a shoe 18 arranged on its lower end which shoe has an inner lip 18*a* formed thereon that is appropriately slanted inwardly away from the shoe end to accomodate a cutter 23 of the tool 10** passing thereby the function of which cutter will be explained in detail later herein.

Figure 2:
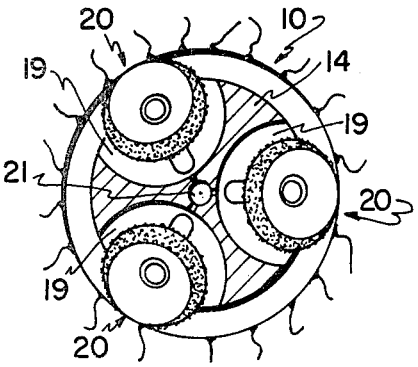

Shown in FIGS. 1 and 2, the tool body 14 is essentially a solid unit having, as has been described, a neck 11 arranged on one end with a recess or collar 15 formed in the other. Further, the tool body 14, as shown best in FIG. 2, has flutes 19 formed therein on 120° centers that are semi-circular in shape, which flutes 19 open to the outer wall of tool body 14 to accommodate cutting elements 20 housed therein whose function will be explained in detail later herein. While these flutes 19 are shown in FIG. 2 as being preferred, it should be obvious that tool 10 could incorporate more than three such flutes, which flutes also could be of a different shape than is shown without departing from the subject matter coming within the scope of this disclosure. While not shown, to facilitate manufacture of tool body 14, it may be most expedient to manufacture the tool body in sections, cutting flutes 19 from a center portion and thereafter joining appropriately top and bottom portions thereof to that fluted center portion to form tool body 14.

As shown best in FIGS. 1 and 2, tool body 14 has a longitudinal passage 21 formed therethrough for receiving mud, fluid or the like from the drill string 12 and passing it therethrough and into the drill bit 13. Further, the tool body has lateral ports 22, shown best in FIG. 1, that extend outwardly, at normal angles, from passage 21 to intersect individual flutes 19 for providing for fluid passage therethrough to scour and purge away materials, such as soil, rock chips, or the like, from within that fluted area for facilitating operation of the cutting element 20 arranged therein, particularly retraction thereof, to within the tool body 14 as will be explained later herein.

Figure 3:
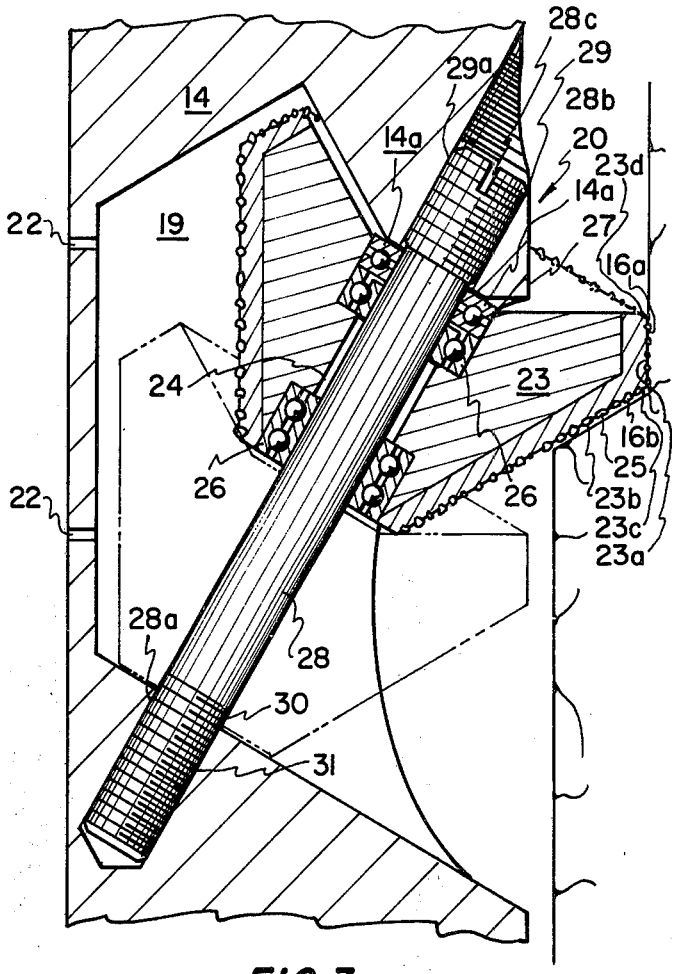

In FIG. 3 is shown a first preferred embodiment of a cutting element 20 arranged in a flute 19 within the tool body 14 with ports 22 shown therein as intersecting flute 19 to pass air or fluid therethrough to clean and scour both the flute 19 and the cutting element 20 itself. The cutting element 20 shown therein perferably involves a cone-shaped cutter 23 that has a center longitudinal bore 24 formed therethrough and has preferably diamond chips or pieces of other cutting or abrasive surfaces 25 secured around the cone outer surface. Bearings 26 are arranged within the the longitudinal bore 24 journaling the cutter 23 to a shaft 28, and a thrust bearing 27 is secured across the longitudinal bore 24 on the top of cutter 23 whose function will be explained later herein. The shaft 28 onto which the cutter 23 is journaled is arranged in an aslant attitude across the flute 19, that shaft initially being turned through an opening 29 that is formed through the tool body 14 outer wall, passing across the flute 19 and its end 28*a* is turned into another hole 30, formed also in the tool body 14. Hole 30 is threaded at 31 as is hole 29 threaded at 29*a* to receive threads formed in shaft 28*a* and in the top thereof at 28*b*. A notch 28*c* is formed across the top end of shaft 28 for receiving a screwdriver blade, or the like, not shown, to turn that shaft appropriately through hole 27 and into hole 30. So arranged, the cutter 23 is free to slide up and down on shaft 28, turning freely thereon around bearings 26, which bearings 26 along with thrust bearing 27 are preferably ball bearings, though other type bearings could conceivably be used for minimizing friction of the cutter 23 when it is turned or moved along shaft 28.

During operation of tool 10, as described hereinabove, cutter 23 is journaled to rotate on shaft 28 and is also arranged to travel vertically thereon. In FIG. 3 the cutter 23 is shown in its extended attitude whereat it will engage and cut, along a flattened outer edge 23*a* thereof, the wall of well bore 16, to form a flattened portion 16*a* with a slanted portion 23*b* of the cutter 23 engaging and forming at 16*b* a slanted wall portion. So arranged, with the cutter 23 in the attitude shown in FIG. 3, the well bore 16 is first formed by bit 13 and is then enlarged to a desired diameter by cutter 23, the cutter 23 first enlarging that well bore by the action of the cutter slanted portion 23*b* and finishing that cut to a smooth wall by action of the flattened outer edge 23*a* thereof. In operation, when a corner 23*c* of cutter 23 between the slanted portion and flattened outer edge 23*a* and 23*b* or the flattened outer edge 23*a* thereof first engages well bore wall, as by turning tool 10 through drill string 12, the cutter being urged outwardly by centrifugal force, the cutter will be caught in that wall and will be pulled therein to its extended attitude as shown in FIG. 3. In this attitude cutter 23 turns freely on bearings 26 and against thrust bearing 27, which thrust bearing 27 is either mounted in tool body 14, adjacent to the top of cutter 23 or is mounted in the cutter itself to engage the tool body at 14*a*. So arranged, a minimal friction load occurs between the cutter 23, shaft 28, and tool body at 14*a*, when the cutter reams the well bore wall as is shown in FIG. 1.

During boring of well bore 16, the cutter 23 is in the attitude shown in FIG. 3, increasing the diameter of that well bore by shaving away the wall thereof to a desired diameter. Thereafter, to remove the drill string 12, connected tool 10, and drill bit 13 from the well bore 16, it is necessary only to discontinue turning of the drill string and to lift it and the connected tool and drill bit from the well bore. During this procedure, when and if the cutter 23 contacts, proximate to its edge 23*d*, any obstruction or the lower end of liner 18, that contact will urge the cutter to slide down shaft 28 to the attitude shown by broken lines in FIG. 3. In this attitude the cutter flat surface 23*a* is contained within tool body 14 and that tool body will pass freely up within liner 18 to the surface. Shown best in FIG. 1, to facilitate this inward sliding of cutter 23 on the aslant shaft 28, the liner shoe end at 18*a* is preferably slanted so as to prohibit cutter 23 from binding thereagainst and possibly damaging the cutter or pulling the liner from the well bore.

It should be noted that the tool body 14 and cutting element 20 can all be manufactured from standard materials for constructing drill bits, cutters, and the like, by standard manufacturing techniques common to the drilling tools manufacturing industry. During such manufacture, particularly the removal of flutes 19 and forming of holes 29 and 30 therein, conventional manufacturing methods and techniques are preferably employed and, if necessary to facilitate such manufacture and to keep costs of manufacture at minimal expense, the tool body 14 can be manufactured in sections as mentioned hereinabove and, thence, joined appropriately into the tool body shown without departing from the subject matter coming within the scope of this disclosure.

Figure 4:
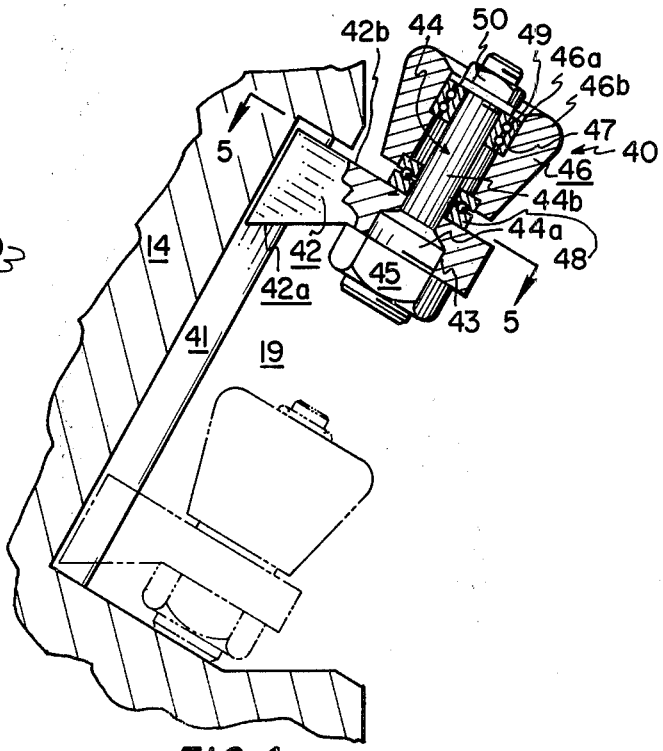
Figure 5:
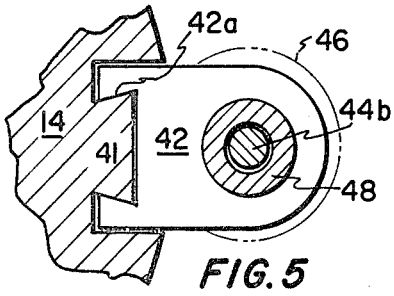

In FIG. 4 is shown another embodiment of a cutting element 40 for use in tool 10 for operation as has been described with respect to cutting element 20. It should, therefore, be understood that cutting element 40 performs the same function in essentially the same manner as does the above described cutting element 20 with the distinction between the two cutting elements being that each cutting element 40 involves a crosshead 42 whereon a cutter 46 is journaled, that crosshead being arranged to slide freely up and down on a crosshead guide 41 that is arranged in an aslant attitude in flute 19 of tool body 14. Shown in FIGS. 4 and 5, the crosshead guide 41 has fitted, in sliding arrangement thereover, a track 42*a* of the crosshead arranged to travel freely thereover. Also, the crosshead has a hole 43 formed therethrough through which hole a post 44, shown in FIGS. 4 and 5, is installed and maintained by a nut 45, said post preferably being parallel to the walls of the crosshead guide 41 and track 42*a*. Post 44, as shown best in FIG. 4, preferably has a larger diameter end at 44*a* for installation through hole 43 in crosshead 42, which hole 43 is tapered appropriately such that post end 44*a* just fits therein, and is reduced therefrom at its opposite end. Over post end 44*b* is shown installed cutter 46, a center longitudinal opening 46*a* formed therethrough fitting over post end 44*b*. Along the post opposite end 44*b*, within the center longitudinal opening 46*a*, are arranged bearings 47, that are preferably ball bearings, but could, of course, be bushings, or the like, with a thrust bearing 48, that is also preferably a ball bearing but could likewise be a bushing, shown sandwiched between the bottom surface of cutter 46 to ride on the top 42*b* of a crosshead 42. The cutter 46 is maintained on post opposite end 44*b* by turning a nut 50 thereover, which nut 50 rides against a washer 49 that extends across the top of opening 46*a* formed through cutter 46. So arranged, cutter 46 is journaled by bearing 47 onto post opposite end 44*b* to turn freely thereon with the thrust bearing 48 dissipating forces encountered that tend to bind the cutter 46 against the top 42*b* of crossarm 42.

Operation of the cutting element 40, it should be understood, is like or similar to that described with respect to cutting element 20, excepting cutter 46 does not move vertically, rather the crossarm 42 on which it is journaled moves vertically. When the tool 10 mounting cutting element 40 is turned, the crosshead 42 will move along the aslant crosshead guide 41, traveling upwardly under the impetus of centrifugal force and will be moved downwardly when the tool is not turned and when a top edge 46*b* of cutter 46 engages and is pushed downward by the wall of the well bore or shoe end of a pipe or liner arranged within that well bore similar to the movement of the described cutter 23 after the drill string attached thereto has ceased turning. When the top edge 46*b* of cutter 46 so engages an obstruction within the well bore, it will, in turn, force crosshead 42 along crosshead guide 41 to the attitude shown by broken lines in FIG. 4, in which attitude the cutting element 40 is stored within the tool body 14 allowing for the tool body 14, drill string and drill bit attached thereto to be withdrawn from the well bore.

Hereinabove, the present invention in a tool 10 has been described as having two preferred embodiments of cutting elements 20 and 40 that each operate essentially in the same manner in that they are arranged to be urged outwardly when tool 10 is turned by a conventional drill string attached thereto, such that edges of cutters thereof contact and are drawn into the wall of a well bore so as to enlarge the diameter thereof to a desired configuration. Retraction of the cutters of these two cutting element embodiments is effected to reposition the cutters within the body of the tool by ceasing to turn the tool and by drawing it upwardly until an edge of the cutter thereof engages an obstruction, either in the wall of the well bore or the shoe end of a pipe or liner therein, with that contact encouraging the cutter to travel back into a recessed storage area within the tool body. The present invention, therefore, involves a cutting element having cutters arranged therewith that, when the tool is turned, will travel outwardly to engage the wall of a well bore and will cut that well bore to a desired configuration by turning of the tool only, which cutters will travel back into the tool to a recessed storage attitude for removal of the tool and connected drill string and drill bit from the well bore when the tool is not turned. Therefore, the present invention should not be limited to a particular configuration of cutting element or cutters therewith shown herein, but should be understood to encompass all cutting elements with cutters capable of traveling, under the urges of centrifugal force only, to engage a wall of a well bore, which cutters will be moved back into a retracted or stowed attitude within the tool body when centrifugal forces are removed therefrom and when the tool body thereof is lifted from the well bore.

While preferred embodiments of the cutting elements for the under reamer tool of the present invention have been shown and described herein, it should be understood that variations, changes, adaptations, modifications and the like may be made to the disclosed invention without departing from the subject coming within the scope and spirit of the following claims, which claims I regard as my invention.

I claim:

1. An under reamer tool comprising, a cylindrical body;

coupling means for connecting said cylindrical body to a conventional drill string;

a plurality of uniformly spaced flutes formed within said cylindrical body;

cutting element means consisting of a cone-shaped cutter arranged within each of said flutes, said cutter having two cutter portions angularly disposed to each other, each cutter portion having an abrasive surface arranged thereon, the larger diameter end of said cone-shaped cutter extending under the urgings of centrifugal force when said under reamer tool is turned into contact with the wall of a well bore, each said cone-shaped cutter to retract, when said under reamer tool is lifted from the well bore, into a stowed attitude in said flute within the line of the outer wall of said cylindrical body;

shafts arranged across said uniformly spaced flutes each in an aslant attitude such that a cutter portion of said cone-shaped cutter journaled thereon, that is free to travel therealong, when in an extended attitude, will form more than a normal angle to said well bore wall; and means for turning said cylindrical body.

2. An under reamer tool as recited in claim 1, wherein there are three uniformly shaped flutes arranged in said cylindrical body on 120° centers from one another around said cylindrical body.

3. An under reamer tool as recited in claim 1, further including coupling means for connecting the cylindrical body to a conventional drill bit; and passage means through said cylindrical body for passing fluid from the drill string therethrough.

4. An under reamer tool as recited in claim 3, further including port means intersecting said passage means and the individual uniformly spaced flutes for passing fluid therethrough to clean said flute and the cutting element means.

5. An under reamer tool as recited in claim 1, wherein the cutting element means consists of, the cone-shaped cutter which has a center longitudinal opening formed therethrough; and bearing means arranged with each said cone-shaped cutter for limiting friction between said shaft and cone-shaped cutter.

6. An under reamer tool as recited in claim 5, further including, thrust bearing means arranged between the cone-shaped cutter and a wall of the flute wherein said cone-shaped cutter is arranged through which flute wall the shaft is fitted at a limit of travel of said cone-shaped cutter on the shaft where the larger diameter end of said cone-shaped cutter extends beyond said cylindrical housing, said thrust bearing means minimizing friction between said cone-shaped cutter and said flute wall.

7. An under reamer tool as recited in claim 1 wherein the cutting element means consists of, the cone-shaped cutter which has a center longitudinal opening formed therethrough;

a crosshead having a post arranged therewith whereon said cone-shaped cutter is journaled through its longitudinal opening, said crosshead having a track formed therewith;

means for maintaining said cone-shaped cutter on said crosshead post;

a crosshead guide arranged in each of the uniformly spaced flutes in an aslant attitude thereacross whereon said crosshead track is arranged in sliding engagement therewith, said crosshead being free to travel along said guide such that, at one limit of travel, said cone-shaped cutter journaled thereon will be housed within said flute, the crosshead traveling therefrom along said guide to extend said cone-shaped cutter larger diameter end and its abrasive surface beyond the cylindrical body; and bearing means arranged with said cone-shaped cutter for limiting friction between said post and cone-shaped cutter.

8. An under reamer tool as recited in claim 7, further including, thrust bearing means arranged between the post and the cross-head for minimizing friction.

* * * * *